US005435763A

United States Patent [19]

Pignata

[11] Patent Number: 5,435,763

[45] Date of Patent: Jul. 25, 1995

[54] OUTBOARD POWER UNIT HAVING AN INTERNAL PROPELLER ASSEMBLY FOR A BOAT

[76] Inventor: Richard Pignata, 8512 Southfield Pl., Raleigh, N.C. 27615

[21] Appl. No.: 283,543

[22] Filed: Aug. 1, 1994

[51] Int. Cl.[6] ..... B63H 1/16

[52] U.S. Cl. ..... 440/67; 440/75

[58] Field of Search ..... 440/38, 67, 76, 78, 440/79, 75; 416/189

[56] References Cited

U.S. PATENT DOCUMENTS

| | | | |
|---|---|---|---|
| 3,361,107 | 1/1968 | Weber | 440/67 |
| 3,951,096 | 4/1976 | Dunlap | 440/75 |
| 5,181,868 | 1/1993 | Gabriel | 440/67 |

FOREIGN PATENT DOCUMENTS

| | | | |
|---|---|---|---|
| 668460 | 11/1929 | France | 416/189 R |

*Primary Examiner*—Jesus D. Sotelo

*Attorney, Agent, or Firm*—Rhodes, Coats & Bennett

[57] ABSTRACT

The present invention entails an outboard power unit comprising an upper drive train compartment, a lower propeller housing, and a pair of laterally spaced connector housings connected between the upper drive train compartment and the propeller housing. An internal propeller assembly is mounted within the lower propeller housing and driven by a flexible drive that is trained around the propeller assembly and extends through the laterally spaced connector housings where the flexible drive is trained around a driven member housed within the upper drive train compartment.

8 Claims, 5 Drawing Sheets

OUTBOARD POWER UNIT HAVING AN INTERNAL PROPELLER ASSEMBLY FOR A BOAT

FIELD OF INVENTION

The present invention relates to inboard and outboard power units for boats and more particularly to an outboard power unit that includes at least an outboard drive train and an internal propeller assembly.

BACKGROUND OF THE INVENTION

The majority of all inboard and outboard drives for power boats utilize a hub-type propeller. While there may be practical advantages to hub-type propulsion systems, there are many disadvantages and drawbacks especially in terms of performance and efficiency. For example, hub-type propeller units inherently experience cavitation problems. Also, most hub-type propellers are designed to be driven by an engine having a vertical drive shaft. Most vertical drive shaft internal combustion engines are of the two-cycle type and consequently tend to pollute the air and water and are not as desirable as four-cycle engines. In fact, it is difficult to adapt a four-cycle engine to a vertical drive.

Another problem associated with hub-type propeller units is that such propellers include a substantial frontal area that is non-performing and therefore creates substantial drag. Moreover, hub-type propellers are required to operate in disturbed water and consequently detracts from the performance and efficiency of hub-type propellers.

SUMMARY AND OBJECTS OF THE PRESENT INVENTION

The present invention entails an internal propeller and an associated drive train for both inboard and outboard boats. In particular, the internal propeller is driven by a flexible drive belt that is trained around an internal propeller assembly and an upper driven member that is stationed outboard of the boat. The flexible drive belt extends through two laterally spaced belt housings that interconnect an upper drive train housing compartment and a lower housing that partially encases the internal propeller.

It is therefore an object of the present invention to provide an efficient internal-type propeller for boats, either inboard or outboard types.

A further object of the present invention is to provide an internal-type propeller for a boat that substantially eliminates cavitation.

Still a further object of the present invention is to provide an internal-type propeller for a boat that can easily be adapted to be powered by a four-cycle engine and particularly a four-cycle engine having a horizontally oriented drive shaft.

Still a further object of the present invention resides in an outboard drive train and associated internal-type propeller for a boat that substantially eliminates the dispersion of motor oil from the engine and its associated drive components and thereby does not unduly pollute the surrounding water.

It is also an object of the present invention to provide an internal-type propeller and associated drive train of the character referred to above that minimizes the non-performing frontal area of the propeller unit and which minimizes the area or quantity of disturbed water that comes into contact with the propeller unit as the boat is propelled through the water.

A further object of the present invention resides in the provision of an internal-type propeller and an associated drive train of the character referred to above wherein the same is supported within a housing that is of a streamline design to minimize water resistance.

A further object of the present invention is to provide an internal type propeller and associated drive train with a housing structure that can be easily broken down or disassembled for convenient access to the drive train and particularly to a flexible drive belt that forms a part of the drive train.

Other objects and advantages of the present invention will become apparent and obvious from a study of the following description and the accompanying drawings which are merely illustrative of such invention.

DETAILED DESCRIPTION OF THE INVENTION

Figure 1:
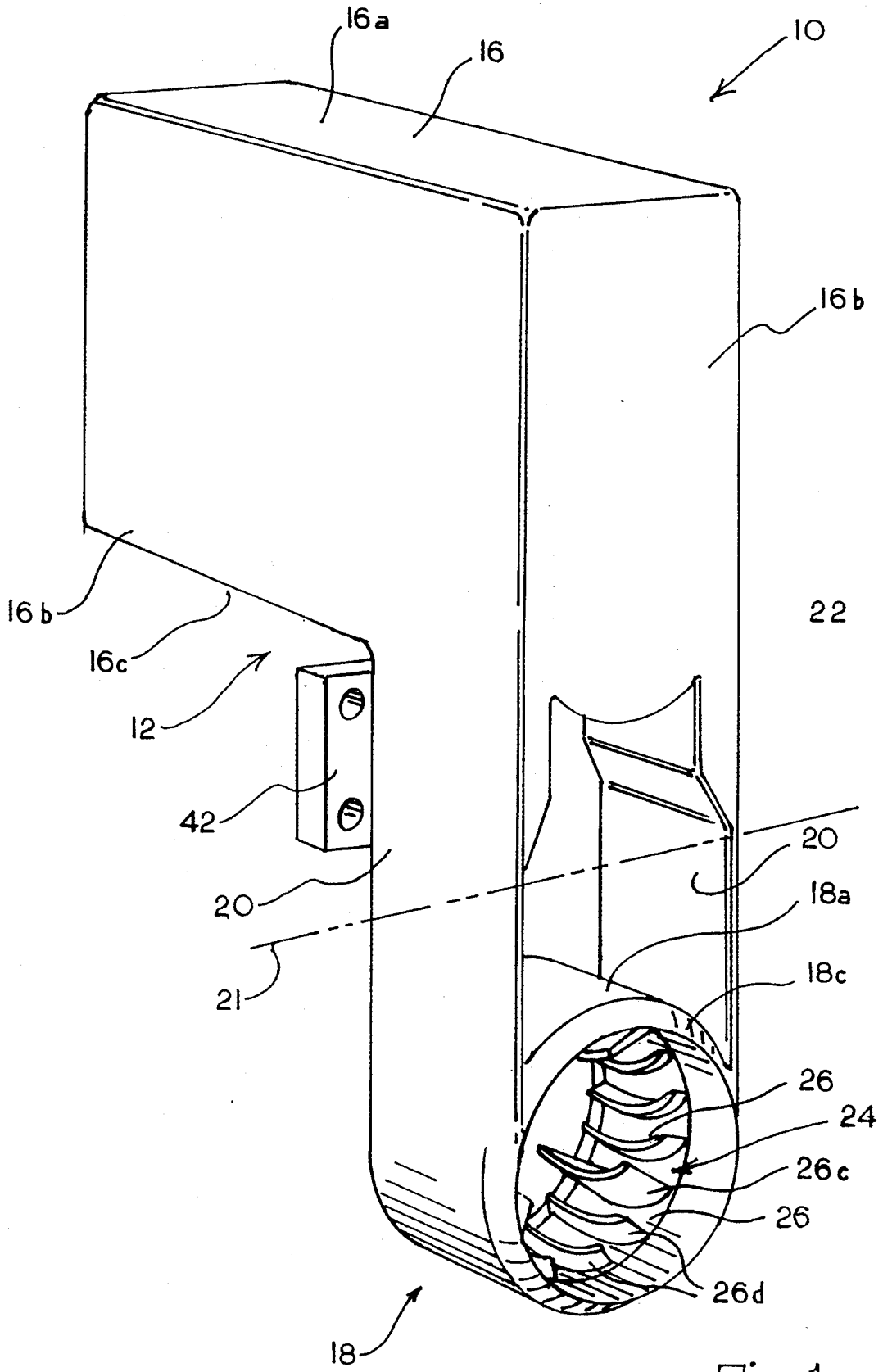
FIG. 1 is a perspective view of the internal propeller and associated drive train of the present invention shown in the form of an outboard unit.

With further reference to the drawings, the outboard power unit of the present invention is shown therein and indicated generally by the numeral 10. Before proceeding with a detailed discussion of the present invention, it should be pointed out that the basic outboard power unit of the present invention entails an internal propeller assembly that is driven by a drive train wherein both the drive train and the internal propeller assembly is disposed outboard of an associated boat. However, the present invention is adapted to be used by boats having inboard and outboard engines. In both cases the internal propeller and an associated drive train will be disposed outboard of the boat.

Now, turning to a discussion of the present invention, the outboard power unit 10 comprises a housing structure indicated generally by the numeral 12 and a drive train indicated generally by the numeral 14 disposed within the housing and designed to drive an internal propeller assembly indicated generally by the numeral 24 and which is housed within the housing structure 12.

First, viewing the housing structure 12, it is seen that the same includes an upper compartment 16, a lower propeller housing or compartment 18 and a pair of belt connector housings 20 that connect the upper compartment 16 with the lower propeller compartment or housing 18. Upper compartment 16 includes a top **16*a*, a series of sides 16*b* and a bottom 16*c*. As will be more fully appreciated from subsequent portions of this disclosure, the upper compartment 16 is designed to house at least a portion of the drive train 14. In the case of an outboard adaptation, the upper compartment 16** will actually house an internal combustion engine having a horizontal drive shaft. In the case of an inboard adaptation, the upper compartment will at least house a main horizontal drive shaft that is driven by an inboard engine.

Spaced below the upper compartment 16 is the lower propeller housing 18. As seen in the drawings, lower propeller housing 18 includes an outer cylindrical wall 18 and a tapered or streamlined leading edge **18*b* and trailing edge 18*c*. Formed about the inside of the propeller housing 18 is an indented inner annular ring 18*d* that, as will be more fully appreciated from subsequent portions of this disclosure, confines a portion of the internal propeller assembly 24. Note that the propeller housing 18 has formed therein opposed edges 18*e* that form opposed edges of the annular ring 18*d***.

Connected between the lower propeller housing 18 and the upper compartment 16 is a pair of enclosed belt or connector housings 20. Belt housings 20 are laterally spaced and are enclosed but are constructed such that they have hollow belt throughways formed therein. In particular, the belt or connector housings 20 are designed such that the belt drive connecting the drive train 14 with the internal propeller assembly 24 extends therethrough. Note in the drawings where the upper portions of the belt housings 20, just above a defined water line indicated by construction line 21, tend to bulge outwardly and provide a greater thickness or depth to the belt housings 20.

In a contemplated design the housing structure 12 would be designed such that it could be easily and conveniently disassembled in order that access may be had to the drive train 14 in encased within the housing structure. In particular, it will be beneficial to gain quick and easy access to a flexible drive belt that forms a part of the drive train.

Defined between the upper compartment 16 and the lower propeller housing 18 and between the belt housings 20 is a substantial open space 22 that permits water to flow therethrough as an associated boat is propelled through the water. It is appreciated that opening 22 contributes to the streamlined design of the total outboard power unit 10 and positively contributes to minimizing resistance as the power unit 10 moves through the water.

As pointed out above, an internal propeller assembly, indicated generally by the numeral 24, is rotatively housed within the lower propeller housing 18. Viewing the internal propeller assembly 24 in more detail, it is seen that the same basically comprises a propeller sleeve 26 that is rotatively journaled within the annular ring **18*d* of the lower propeller housing 18. Propeller sleeve 26 includes about its outer surface a central drive track 26*a*. Disposed on each side of the central drive track 26*a* is an indented or recessed race 26*b*. As seen in the drawings, a series of blades 26*c* and 26*d* are secured to the inner circular wall of the propeller sleeve 26 and project inwardly therefrom. In particular, reference 26*c* refers to large blades while reference 26*d*** refers to smaller blades dispersed between the larger blades.

Formed in the lower propeller housing 18 are a series of bearings that engage various parts of the internal propeller assembly and particularly the propeller sleeve 26 for maintaining and confining the internal propeller assembly 24 within the lower propeller housing 18. The bearings include a series of upper bearings 28 that are rotatively held and supported by the propeller housing 18 about the upper portion thereof. Note that the upper bearings 28 are disposed on each side of the central drive track **26*a* and actually engage the exposed surfaces of the respective indented races 26*b*. Thus, it is appreciated from the drawings that the upper bearings 28 limit the upward movement of the propeller sleeve 26** and provide a bearing surface for the propeller sleeve to rotate against.

To control the fore and aft movement of the propeller sleeve 26, the lower propeller housing 18 is provided with a series of thrust bearings 30. As seen in the drawings, the respective thrust bearings 30 are rotatively mounted in the opposed edges **18*e* that are disposed adjacent the inner annular ring 18*d*. Consequently, the respective thrust bearings 30 face opposed edges of the propeller sleeve 26. The opposed thrust bearings 30 are preferably spaced such that the propeller sleeve when properly aligned between the respective thrust bearings 30 may not actually engage the thrust bearings 30. However, any fore and aft movement of the propeller sleeve 26 may cause an edge thereof to engage a respective thrust bearing 30. Consequently, as noted above, thrust bearings 30 limit the fore and aft movement of the propeller sleeve 26**.

Now turning to the drive train 14, first the outboard adaptation of the present invention will be discussed. In this regard, the drive train 14 includes an internal combustion engine 32 mounted directly in the upper compartment 16 of the overall housing structure 12. Engine 32 includes a horizontal drive shaft that is connected to a conventional clutch and/or transmission. The clutch and/or transmission is operatively connected to a drive sheave or driven member 38. A flexible endless drive belt 40 is trained around drive sheave 38 and the central drive track **26*a* of the propeller sleeve 26. Note that the flexible belt 40 is threaded through the belt housings 20 such that the belt is essentially enclosed by the overall housing structure 12. Also, it is appreciated that the flexible belt 40, being trained around the lower portion of the propeller sleeve 26, actually supports the propeller sleeve 26 within the lower propeller housing 18**.

Mounted to the outboard power unit 10 is a rotatable mounting plate 42 that enables the entire outboard power unit 10 to be pivoted with respect to the boat such that the power unit can not only be used for propulsion but can also be used for steering.

Figure 2:
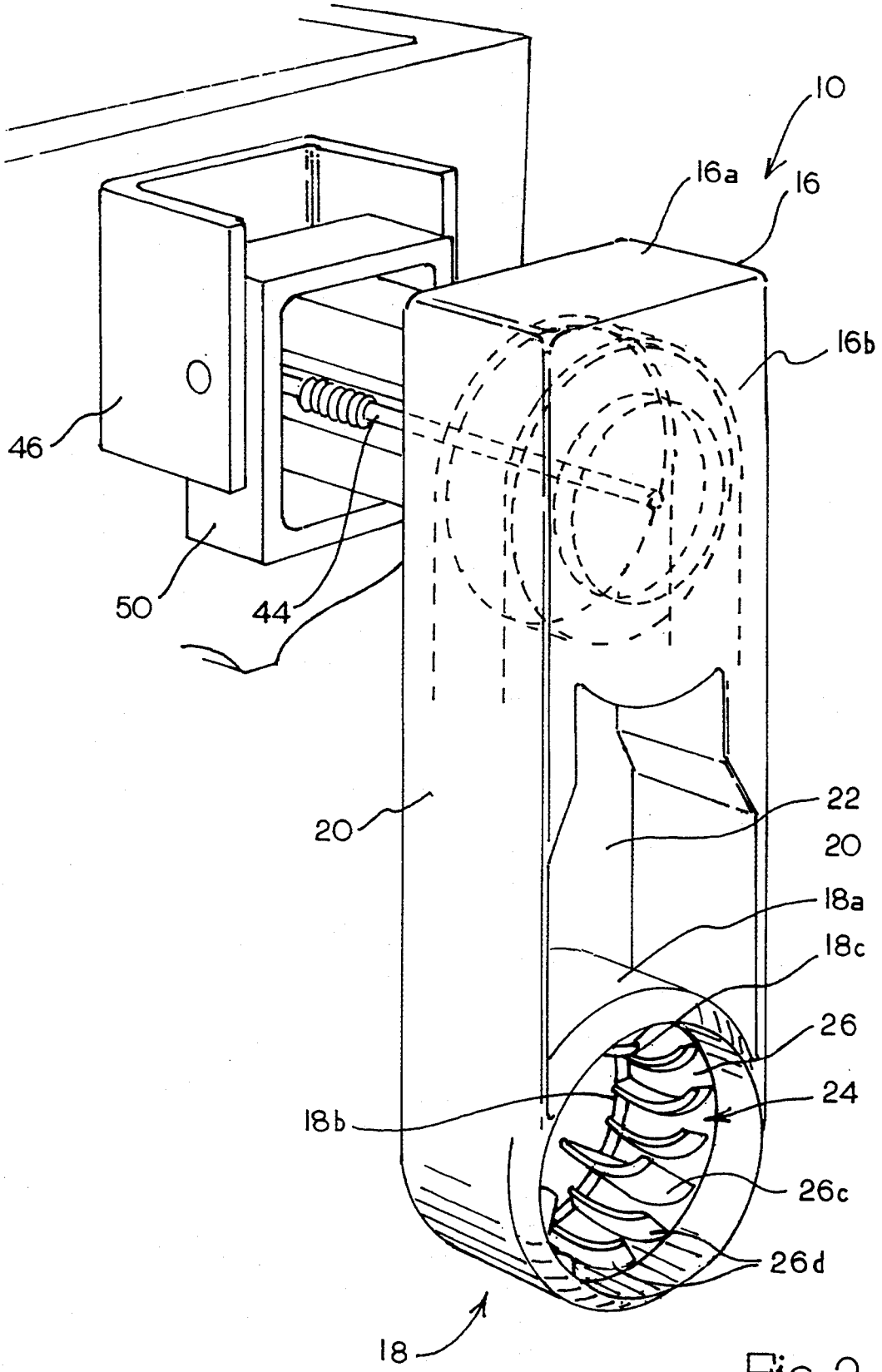
FIG. 2 is a perspective view of the internal propeller and associated drive train of the present invention shown in the form of an inboard/outboard unit.
Figure 3:
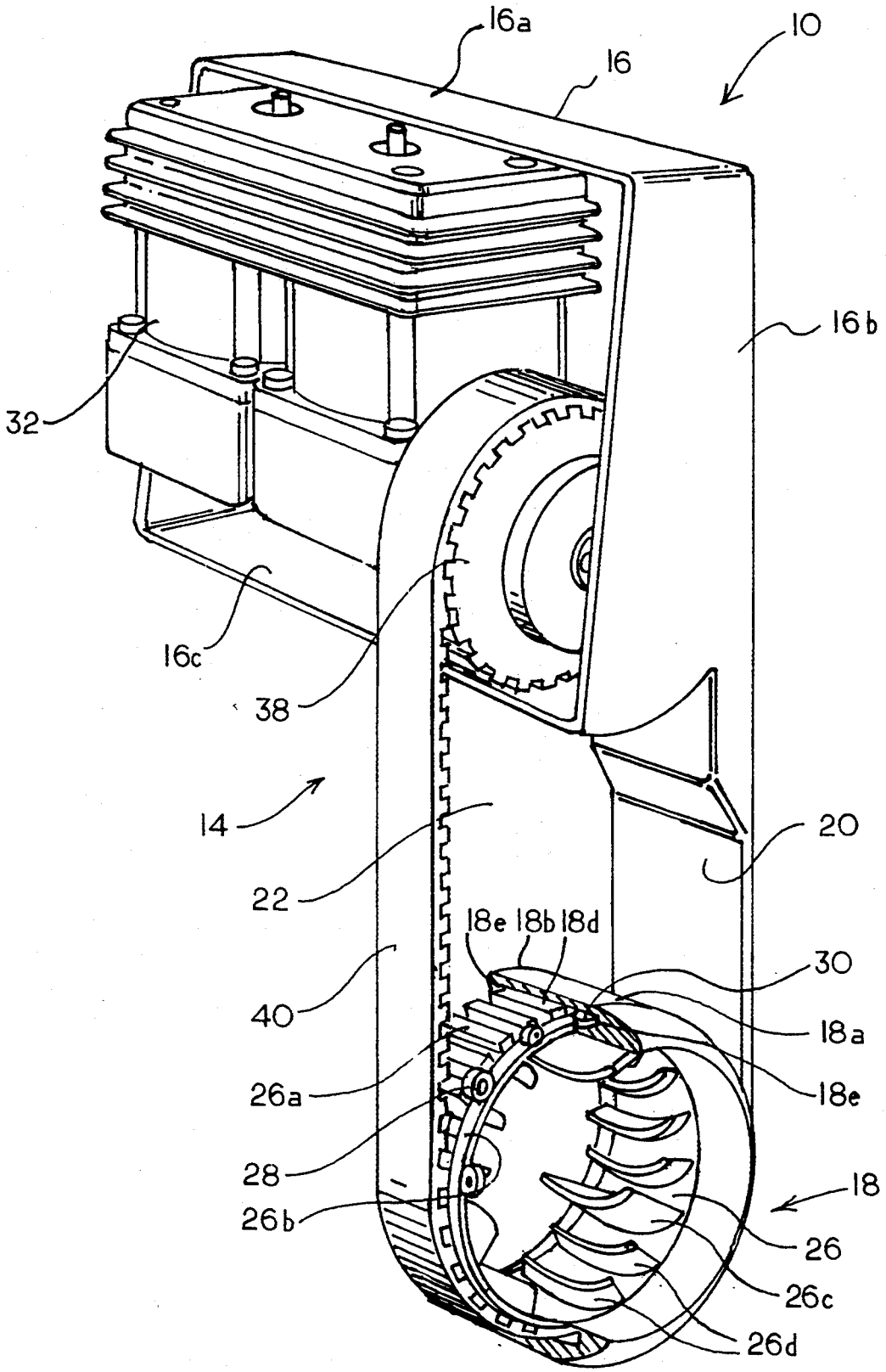
FIG. 3 is a fragmentary perspective view of the internal propeller and associated drive of the type shown in FIG. 1 with portions of the housing structure broken away to better illustrate the present invention.
Figure 4:
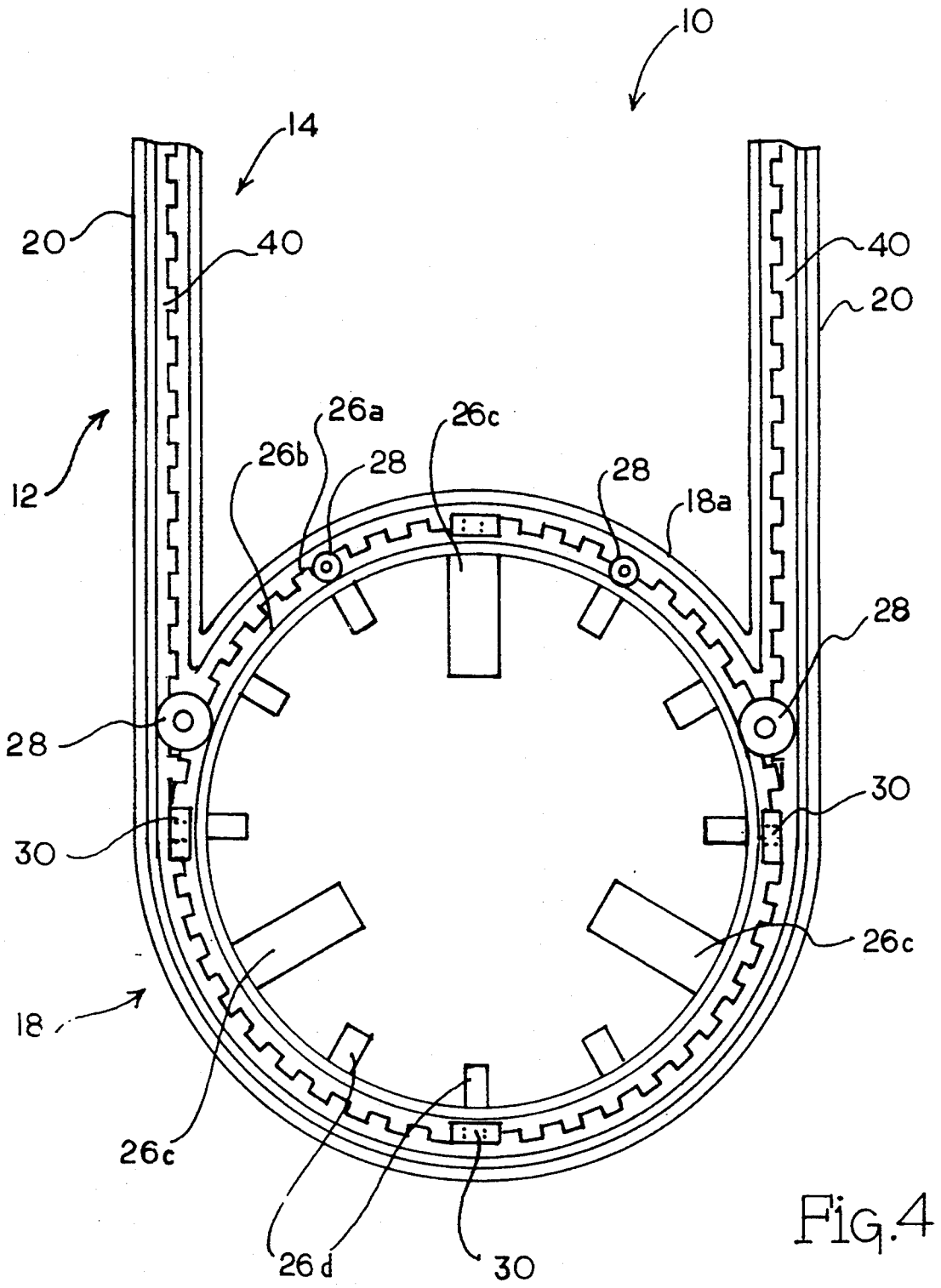
FIG. 4 is a fragmentary front elevational view of the internal propeller of the present invention and a portion of the flexible drive belt associated therewith with portions of the front housing removed to better illustrate the structure thereof.
Figure 5:
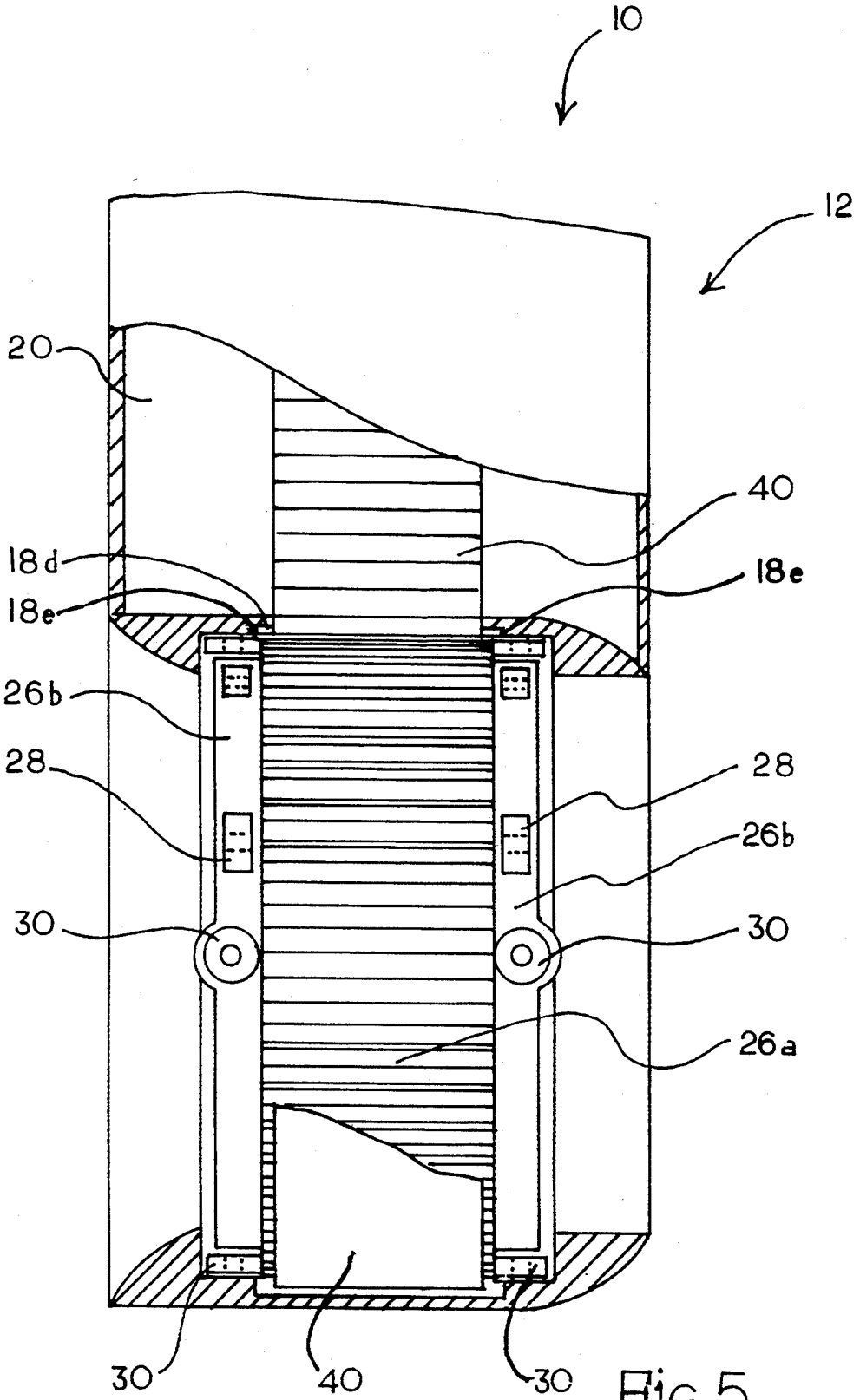
FIG. 5 is a fragmentary side sectional view of the internal propeller of the present invention.

Now, turning to a discussion of the inboard/outboard adaptation of the present invention and a discussion of the drive train 14 therefore, one is referred to FIG. 2. In the case of an inboard/outboard adaptation, there is provided a universal drive shaft 44 that is operatively connected to an inboard engine (not shown) and is also operative to drive a drive sheave 38 mounted in the upper compartment 16. Note that in the inboard/outboard adaptation, the universal drive shaft 44 is housed within a drive housing 48 that is supported within a surround collar 50 which is in turn secured to a yoke 46 that is adapted to be mounted to the boat. In the case of the inboard/outboard adaptation, it is appreciated that torque from an inboard engine is transmitted through the universal drive shaft 44 which is operative to drive the drive sheave 38 disposed within the upper compartment 16. Like the outboard adaptation, a flexible belt 40 is trained around the drive sheave 38 and around the lower portion of the propeller sleeve 26 for driving the internal propeller 24.

In operation, it is appreciated that driving torque is provided through a horizontal drive shaft that extends through the upper compartment 16 of the overall housing structure 12. The horizontal drive shaft in turn drives a drive sheave or driven member 38 that is also disposed in the upper compartment. Torque from the drive sheave 38 is transferred to the internal propeller assembly 24 via the endless flexible drive belt 40. It is appreciated that the drive belt extends around the lower run or portion of the propeller sleeve 26 and in fact supports the same. In particular, the flexible drive belt 40 supports and pulls the propeller sleeve 26 upwardly against the upper bearings 28. Consequently, the propeller sleeve 26 is confined between the upper bearings 28 and the flexible belt 40. As the drive belt 40 moves through the housing 12, it is appreciated that the same drives and rotates the propeller sleeve 26 causing the internal blades **26*c* and 26*d* to be turned and consequently causes the boat associated with the power unit 10** to be propelled through the water.

From the foregoing specification and discussion, it is seen that the outboard power unit 10 of the present invention overcomes many of the drawbacks and disadvantages of hub-type propellers for inboard and outboard power systems. In the case of the present design, it is appreciated that cavitation is avoided and propeller frontal area is minimized. In addition, the present design enables the outboard power unit to incorporate an upper horizontal drive assembly and in the case of an outboard adaptation the power unit can even utilize an internal combustion engine having a horizontal drive. Further, the design of the outboard power unit 10 of the present invention is such that the leakage and spillage of oil from the engine and the housing is virtually eliminated.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An outboard power unit for guiding and propelling a boat comprising:

a) a housing structure including:
   1) an upper drive train compartment;
   2) a lower propeller housing having an open central section; and
   3) a pair of laterally spaced connector housings connected between the drive train compartment and the propeller housing;

b) a substantial open area defined between the connector housing, upper drive compartment, and the lower propeller housing that enables water to flow therethrough as the power unit propels the boat through the water;

c) an internal propeller assembly mounted in the lower propeller housing and including a driven propeller sleeve having outer and inner cylindrical walls and wherein there is provided a series of propeller blades extending inwardly from the inner wall of the propeller sleeve;

d) a drive train disposed in the upper compartment and including a horizontal drive shaft and a rotary driven member driven by the horizontal drive shaft;

e) an endless flexible drive member trained around both the rotary driven member in the upper housing compartment and the propeller sleeve for transferring torque from the rotary driven member in the upper housing compartment to the propeller sleeve and for supporting the propeller sleeve from beneath in the lower propeller housing;

f) wherein the endless flexible member extends through and is confined within the two laterally spaced connector housings connected between the upper housing compartment and the lower propeller housing;

g) a movable connecting plate connected to the outboard power unit for enabling the same to be connected to the boat such that the power unit can be moved relative to the boat for guiding the same;

h) a plurality of fore and aft thrust bearings supported in the lower propeller housing and disposed on opposite sides of the propeller sleeve for limiting the fore and aft movement of the propeller sleeve; and i) a plurality of upper bearings supported in the lower propeller housing and engaged with only an upper portion of the propeller sleeve as the propeller sleeve is driven by the flexible drive member, the upper bearings being circumferentially spaced around an upper portion of the propeller sleeve and engaged therewith such that the propeller sleeve is supported and held between the flexible drive member and the upper bearings.

2. The outboard power unit of claim 1 wherein each of the two connector housings are relatively thin.

3. The outboard power unit of claim 2 wherein the flexible drive member comprises a belt and wherein the two connector housings include an elongated passageway extending completely therethrough from the upper housing compartment to the lower propeller housing and wherein the flexible belt passes through the elongated passageway in each of the connector housings.

4. The outboard power unit of claim 1 wherein the drive train includes an internal combustion engine mounted within the upper housing compartment and wherein the internal combustion engine is operative to drive the horizontal drive shaft and the rotary driven member.

5. The outboard power unit of claim 1 wherein the outer wall of the propeller sleeve includes a central drive track and a pair of races with each race extending on a respective side of the drive track.

6. The outboard power unit of claim 1 wherein the propeller blades include a series of relatively large blades extending inwardly from the inner surface of the propeller sleeve and a series of relatively small blades spaced between the relatively large blade and extending inwardly of the inner surface of the propeller sleeve.

7. The outboard power unit of claim 1 wherein the same is adapted to be used in conjunction with an inboard power plant and wherein there is provided means for connecting the drive train disposed in the upper housing compartment with an inboard power plant mounted inboard of the boat.

8. The outboard power unit of claim 1 wherein there is only one undivided, uninterrupted open area defined between the connector housing, the upper drive compartment, and the lower propeller housing.

* * * * *